United States Patent [19]

Cone

[11] Patent Number: 4,598,946

[45] Date of Patent: Jul. 8, 1986

[54] ROCKING INFANT SEAT

[75] Inventor: Richard E. Cone, Dayton, Ohio

[73] Assignee: Collier-Kenworth Company, Gardner, Mass.

[21] Appl. No.: 688,335

[22] Filed: Jan. 2, 1985

[51] Int. Cl.[4] ..... A47C 3/021

[52] U.S. Cl. ..... 297/258; 297/264; 297/303

[58] Field of Search ..... 297/258, 325, 264, 303, 297/265; 248/371, 346 Q, 346 N, 346 P

[56] References Cited

U.S. PATENT DOCUMENTS

| | | | |
|---|---|---|---|
| 30,706 | 11/1860 | Van Vleck | 297/325 X |
| 200,296 | 2/1878 | Hesse | 297/264 |
| 423,882 | 3/1890 | Stevens | 297/265 |
| 1,358,640 | 11/1920 | Koyama | 297/303 X |
| 3,522,925 | 8/1970 | Buchtel | 248/371 |
| 4,128,273 | 12/1978 | Jones | 297/265 X |
| 4,236,752 | 12/1980 | Mizelle | 297/303 |
| 4,365,779 | 12/1982 | Bates et al. | 248/179 X |
| 4,372,606 | 2/1983 | Faull | 297/258 X |
| 4,415,136 | 11/1983 | Knoll | 248/181 |

FOREIGN PATENT DOCUMENTS

| | | | |
|---|---|---|---|
| 1491608 | 4/1967 | France | 297/258 |

*Primary Examiner*—William E. Lyddane
*Assistant Examiner*—José V. Chen

[57] ABSTRACT

A rocking infant seat having an adjustable at-rest position includes a seat having an arcuate lower support surface resting on a planar base, a slot in the seat, and a bolt extending through the slot to secure the seat to the base.

11 Claims, 9 Drawing Figures

FIG 1
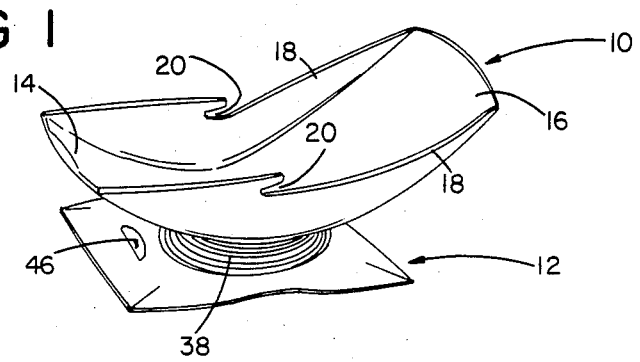
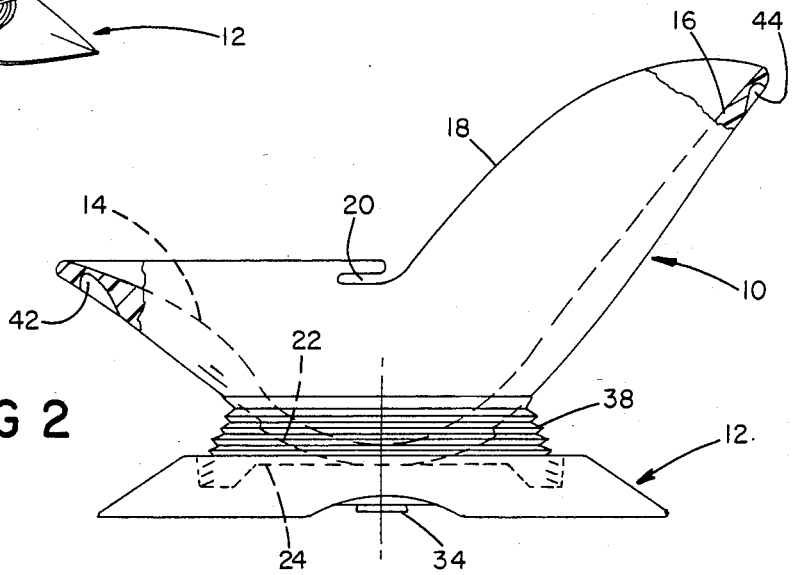
FIG 2
FIG 3
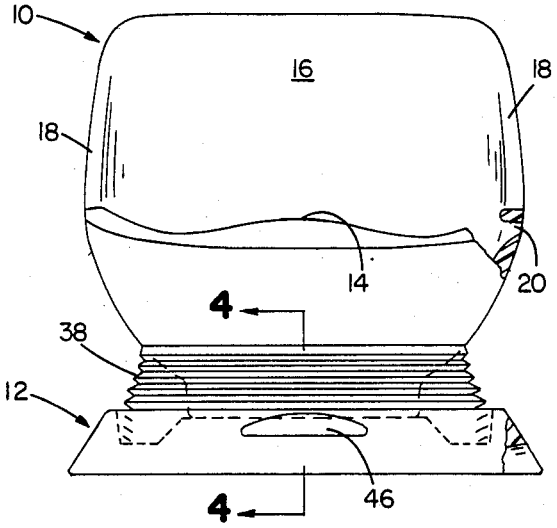
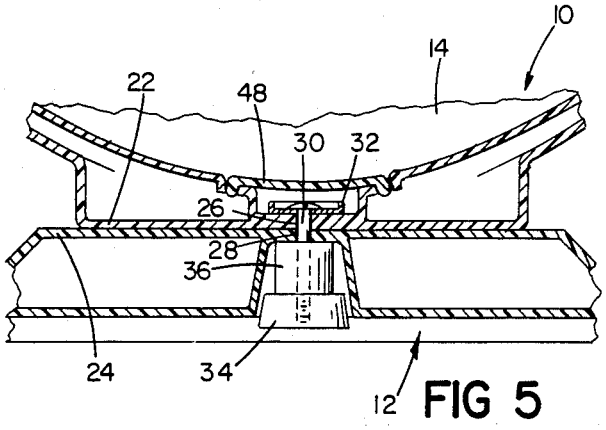
FIG 5
FIG 4
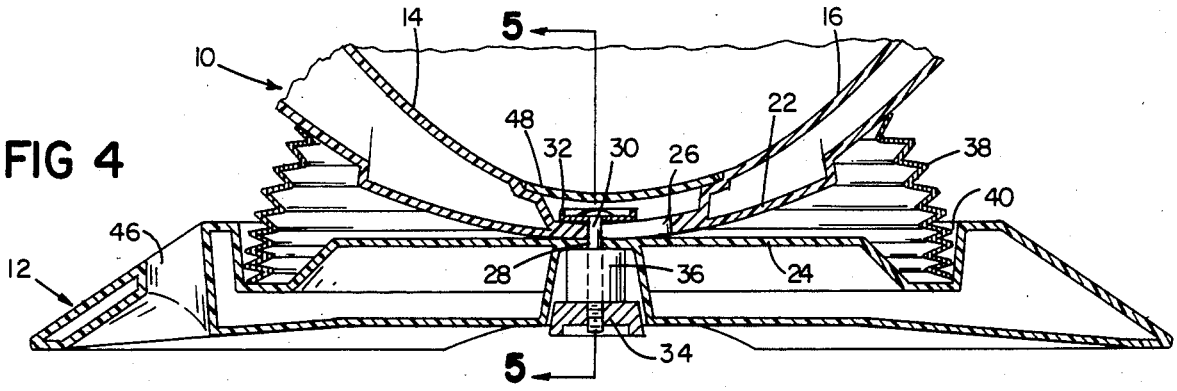

FIG 6
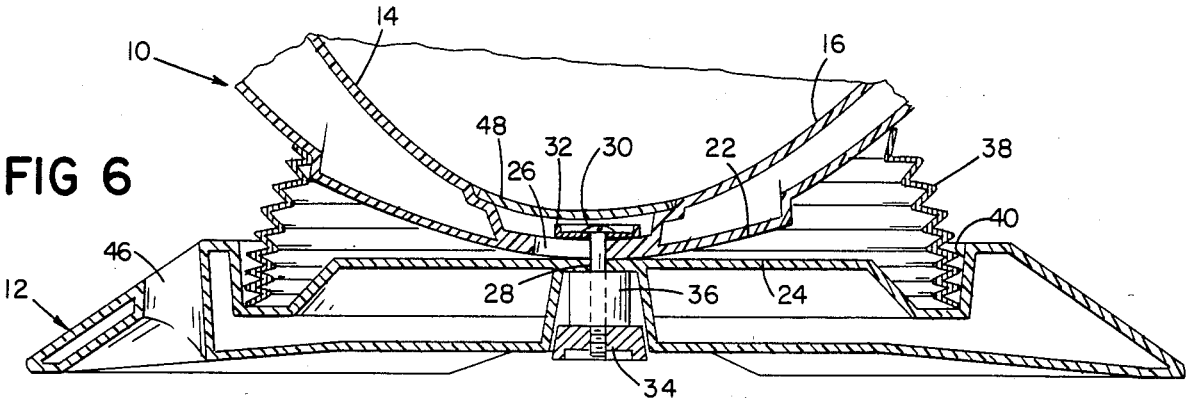
FIG 8
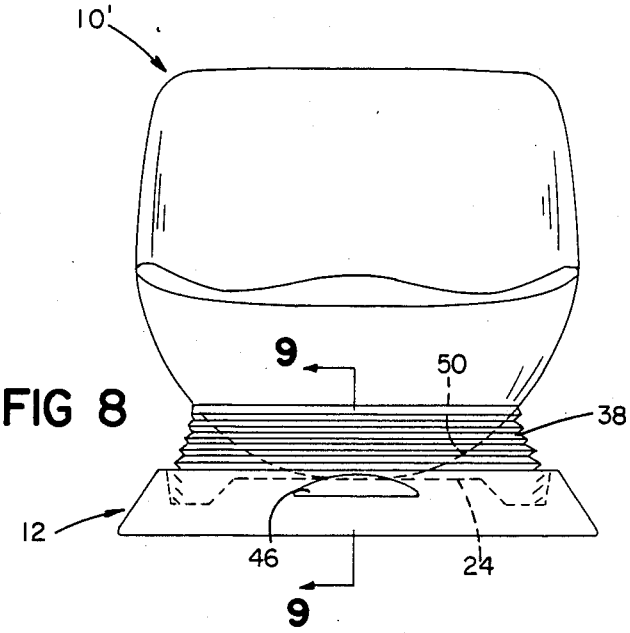
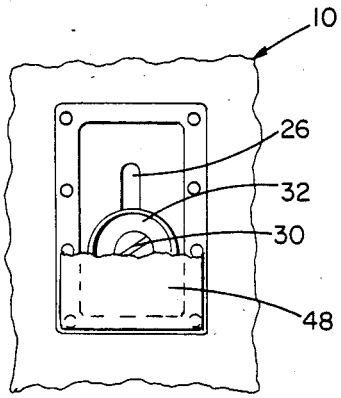
FIG 7
FIG 9
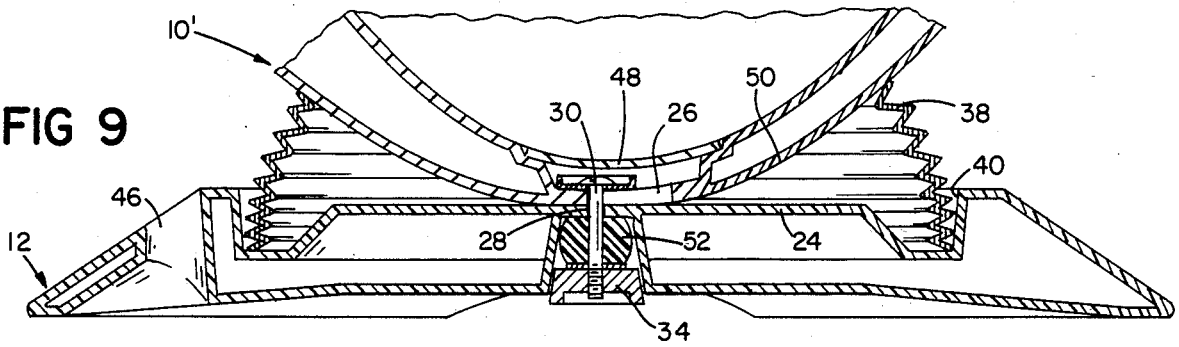

ROCKING INFANT SEAT

This invention relates to a rocking infant seat and pertains more specifically to a rocking infant seat having an adjustable at-rest position and suitable for use as an infant car seat.

It has previously been proposed to provide rocking chairs which are capable of rocking in a single plane from a single, fixed, at rest position, as for example is shown in Doubler U.S. Pat. No. 116,571 and in British Pat. No. 1,d379,042 (1975). However, such chairs lack any provision for adjusting or changing the initial at-rest positions of the chair and the chair is incapable of universal motion, i.e. simultaneous lateral and fore and aft rocking of the chair with respect to the base.

The present invention provides a rocking seat having an adjustable at-rest position comprising a seat having a lower convexly arcuate support surface, a base having a generally planar upper surface, and means for securing said seat to said base with said support surface resting on said base surface to form an assembly, said means including a slot in said support surface, a bolt extending through said slot, and means for releasably connecting said bolt to said seat and said base at any one of a plurlity of at-rest positions in said slot, said assembly including yieldable means to permit said support surface to rock upon said base surface to and from its at-rest position.

The invention also features such a seat in an embodiment in which the lower support surface adjacent the slot is formed of resilient flexible material to permit rocking of the seat when the seat and base are bolted together. In another embodiment a separate spring is provided with the bolt to ensure a yieldable connection which permits rocking.

In the drawings,

FIG. 1 is an isometric view of one embodiment of the invention;

FIG. 2 is a view in side elevation, partly broken away and in section;

FIG. 3 is a view in front elevation partly broken away and in section;

FIG. 4 is a view in vertical section along line 4—4 of FIG. 3, partly broken away, showing the seat in one at-rest position;

FIG. 5 is a view in section taken along line 5—5 of FIG. 4;

FIG. 6 is a view in section corresponding to that of FIG. 4 showing the seat in a second at-rest position;

FIG. 7 is a plan view partly broken away showing the connection of the seat to the base;

FIG. 8 is a front view partly broken away and in section showing a second embodiment of the invention; and FIG. 9 is a view in section taken along line 9—9 of FIG. 8.

Referring to the drawings, the embodiment of the rocking infant car seat shown in FIGS. 1–7 comprises a one-piece unitary molded plastic seat 10 mounted on a one-piece molded plastic base 12. Seat 10 includes a bottom 14 and back 16 together with two sides 18, 18. An open-ended slot 20 is provided in each side for reception of a conventional automobile seat belt to maintain the seat and base in position in an auto. Seat 10 is provided with a lower convexly arcuate support surface 22 which is a portion of a cylinder having its axis extending parallel to the junction of bottom 14 and back 16.

Base 12 is also preferably of molded plastic construction generally rectangular in plan and having a flat or generally planar upper surface 24 on which lower support surface 22 rests. Slot 26 is provided in seat 10 adjacent the juncture of the bottom and the back and extending at right angles thereto, parallel to the sides 18, 18. A mating hole 28 is provided in upper surface 24 of base 12. There extends through slot 26 and hole 28 a bolt 30 having a flanged washer 32 at its upper end bearing on the inner surface of seat 10 and threaded at its lower end to receive nut 34 which bears against the bottom surface of base 12 through metal sleeve or spacer 36. In this embodiment seat 10 or base 12 or both are made of flexible, resilient plastic material having inherent elasticity and capable of limited distortion in the area of the support surface 22 and/or of the upper surface 24 of the base adjacent the slot 26 and hole 28.

A safety shield in the form of a flexible collapsible open-ended bellows wall 38 of generally cylindrical or truncated conical configuration made of molded plastic material is mounted in annular channel 40 in the upper surface of base 12. Bellows 38 extends continuously from the upper surface 24 of base 12 to the outer surface of seat 10 in position to surround bolt 30 in spaced relation thereto.

Handholds 42, 44, as best appears in FIG. 1, are molded into the outer surface of seat 10 adjacent the margins of bottom 42 and back 16 to facilitate moving and carrying the assembled seat and base. Molded handhold 46 is also provided in base 12, as appears in FIGS. 3 and 4, to facilitate handling.

A removable cover plate 48 is provided in the inner surface of seat 10 to cover slot 26 and the head of bolt 30.

When the seat and base are assembled together with bellows shield 38, bolt 30 and nut 34 can be tightened while the bolt extends through slot 26 at any position along the length of the slot so that seat 10 remains in a desired at-rest position, as shown, for example, in FIGS. 2–4. When it is desired to change the at-rest position, the bolt and nut are loosened to permit sliding of the seat so that bolt 30 occupies a different position within slot 26 and then retightened as shown in FIG. 6. Because of the inherent flexible nature of molded plastic seat 10 in the area adjacent slot 26, as well as the similar flexibility of the base 12 adjacent hole 28, the seat is capable of rocking movement of lower support surface 22 on the upper surface 24 of base 12 in response to changes in position of the infant or child occupying the seat or in response to forces applied to the upper end of back 16 or the forward end of bottom 14, as desired. Safety shield 38 prevents accidental pinching of fingers or toes between the seat and base during rocking movement.

It should be noted that the embodiment shown in FIGS. 1–6 of the drawing is capable of swivelling movement of seat 10 with respect to base 12 about bolt 30 as an axis, but that rocking movement of the seat is confined to substantially a single plane because of the cylindrical shape of the bottom surface 22.

In the embodiment shown in FIGS. 8–9 of the drawing, seat 10 is provided with a lower support surface 50 which is generally dome shaped, preferably in the form of a portion of a sphere, while the base 12 and the remainder of seat 10 are identical to the first embodiment. As shown in FIG. 9, a spring in the form of a rubber ring 52 replaces metal sleeve or spacer 36, surrounding the shank of bolt 30 and being captured between the bottom of base 12 and nut 34.

The initial or at rest position of the seat in this embodiment can be adjusted in the same way as in the case of the embodiment of FIGS. 1–6. However, yieldable compression member 52 acts as a spring to permit rocking movement of seat 10 with respect to base 12 even when the seat and the base are of rigid inflexible construction. In addition, the embodiment of FIGS. 8 and 9 is capable of rocking movement in any direction, both laterally and fore and aft, because of the dome-like or spherical configuration of lower support surface 50.

What is claimed is:

1. A rocking seat having an adjustable at-rest position comprising a seat having a lower convexly arcuate support surface, a base having a generally planar upper surface, and means for securing said seat to said base with said support surface resting on said base surface to form an assembly, said means including a slot in said support surface, a bolt extending through said slot, and means for releasably connecting said bolt to said seat and said base at any one of a plurality of at-rest positions in said slot, said assembly including yieldable means to permit said support surface to rock upon said base surface to and from its at-rest position.

2. A rocking seat as claimed in claim 1 in which said yieldable means includes the support surface adjacent said slot.

3. A rocking seat as claimed in claim 1 in which said yieldable means includes a spring between said bolt and one of said seat and said base urging said support surface against said base surface.

4. A rocking seat as claimed in claim 3 in which said slot is located adjacent the juncture of said bottom and said back.

5. A rocking seat as claimed in claim 3 in which said spring is disposed between one end of said bolt and the adjacent seat or base in position to be compressed by rocking of said seat away from said at-rest position.

6. A rocking seat as claimed in claim 1 in which said support surface is cylindrical and said slot is transverse to the major axis of said cylindrical support surface.

7. A rocking seat as claimed in claim 6 in which said seat includes a bottom, back, and sides, and said slot extends generally parallel to said sides adjacent the juncture of said bottom and said back.

8. A rocking seat as claimed in claim 1 in which said support surface is a segment of a sphere.

9. A rocking seat as claimed in claim 1 in which said seat includes a bottom, back, and sides, and said slot extends generally parallel to said sides.

10. A rocking seat as claimed in claim 1 which includes a safety shield in the form of a flexible collapsible bellows wall surrounding and spaced from said connecting means and extending continuously from said lower support surface to said upper surface of said base.

11. A rocking seat as claimed in claim 10 in which said seat includes a bottom, back, and sides, and said slot extends generally parallel to said sides adjacent the juncture of said bottom and said back.

* * * * *